166-275
10/21/80 XR 4,228,854 SR

United States Patent [19]

Sacuta

[11] 4,228,854

[45] Oct. 21, 1980

[54] ENHANCED OIL RECOVERY USING ELECTRICAL MEANS

[75] Inventor: Aleksy Sacuta, Edmonton, Canada

[73] Assignee: Alberta Research Council, Edmonton, Canada

[21] Appl. No.: 66,179

[22] Filed: Aug. 13, 1979

[51] Int. Cl.[3] ..... E21B 43/22; E21B 43/24; E21B 43/25

[52] U.S. Cl. ..... 166/248; 166/272; 166/275

[58] Field of Search ..... 166/248, 272, 275

[56] References Cited

U.S. PATENT DOCUMENTS

| | | | |
|---|---|---|---|
| 2,211,696 | 8/1940 | Irons | 166/248 X |
| 2,795,279 | 6/1957 | Sarapuu | 166/248 |
| 2,799,641 | 7/1957 | Bell | 166/248 |
| 3,417,823 | 12/1968 | Faris | 166/248 |
| 3,530,936 | 9/1970 | Gunderson et al. | 166/248 |
| 3,642,066 | 2/1972 | Gill | 166/248 |
| 3,782,465 | 1/1974 | Bell et al. | 166/248 |
| 3,948,319 | 4/1976 | Pritchett | 166/248 |
| 4,037,655 | 7/1977 | Carpenter | 166/248 |
| 4,084,638 | 4/1978 | Whiting | 166/248 |

*Primary Examiner*—Stephen J. Novosad
*Attorney, Agent, or Firm*—Ernest Peter Johnson

[57] ABSTRACT

A process is provided for recovery of oil from an oil and water bearing formation wherein spaced injection and production wells penetrate the formation and a drive fluid is injected through the injection well into the formation. A unidirectional electrical potential gradient is maintained between anode means in the production well and cathode means in the injection well adjacent the formation. In this manner, water flow toward the production well is retarded to enhance recovery efficiency. The process is particularly applicable in heavy-oil-bearing formations. In this case the formation is first preheated and heated drive fluids injected to improve the oil mobility within the formation.

4 Claims, 1 Drawing Figure

SUGGESTED POLYPHASE
HEATED WELL PATTERNS

4-SPOT 3-PHASE

7-SPOT 3-PHASE

ENHANCED OIL RECOVERY USING ELECTRICAL MEANS

BACKGROUND OF THE INVENTION

The present invention relates to an oil recovery process utilizing electrical means, and more particularly to a process wherein an electrical potential gradient is established across an oil-bearing formation to enhance oil recovery.

It is well documented that the flow of fluids through porous media results when a directional potential is applied across the media containing the fluids. This fluid flow, known as the electroosmotic effect, is due to electrically charged layers of opposite signs at the boundary between the fluid and porous media. See for example Textbook of Physical Chemistry, Second Edition, S. Glasstone, MacMillan and Co. Ltd., 1948, page 1219.

Processes utilizing the transfer of reservoir fluids by electroosmosis are described in, for example, U.S. Pat. Nos. 3,642,066 to Gill, and 2,799,641 to Bell. These and other prior art processes have been concerned with increasing the fluid flow within the formation toward a production well. To that end, the polarity of the electrode means in an injection and production well has, by convention, been positive and negative respectively, in order to assist fluid flow.

It is also known in the prior art to dewater an oil-bearing formation by applying a potential field between an anode and a cathode within an injection or production well. For instance, in the process set forth in U.S. Pat. No. 3,417,823 to Faris, a drainage area is set up around the cathode to collect water away from a production zone.

In a number of experiments performed by the inventor following the prior art teachings at least two adverse effects were noted in the recovery, which effects have not been well documented in the literature. The experiments involved injecting hot displacement fluids through an injection well into an oil sand-packed tube while maintaining a unidirectional potential positive to negative between spaced injection and production wells respectively. The effects noted were, firstly, there was an early breakthrough of water at the production well, and secondly, the oil to water ratio of the produced fluids rapidly decreased on continued production.

SUMMARY OF THE INVENTION

The inventor has discovered in a series of laboratory experiments using oil sand-packed tubes that, if the unidirectional electrial potential gradient across an oil-bearing zone is reversed—such that it is negative to positive in the direction of fluid injection—there is a delay in the injected fluid breakthrough. Further, even after breakthrough, the oil-to-water ratio of the produced fluids remains higher than is the case if no such potential is applied, resulting in higher oil recoveries. The applied polarized voltage appears to retard or oppose the water phase flow with respect to the oil phase flow. With continued injection of the displacement fluid, oil is displaced in a greater proportion than would be the case if the voltage were not applied.

The process of the present invention has been shown to be effective in the recovery of oil from heavy oil-bearing materials, such as tar sand derived from the tar sand and heavy oil deposits of Alberta.

The injection fluid effective in the process of the present invention can be chosen from a number of the common displacement drive fluids. For example, steam; water; brine; water and a surfactant; water and a polymer; water, surfactant and a polymer; emulsions containing water, organic solvents and a surfactant, and combinations thereof have successfully been tested.

Broadly stated, the invention provides an improvement in a process for recovering oil from an oil and water bearing formation wherein spaced injection and production wells penetrate the formation and a drive fluid is injected into the formation through the injection well to assist in producing oil and some water through the production well. The improvement comprises: maintaining a unidirectional electrical potential gradient between anode means located in the production well and cathode means located in the injection well adjacent the formation, to retard water flow to the production well.

The invention also broadly provides an improvement in a process for recovering oil from an oil and water bearing formation wherein at least two spaced wells penetrate the formation and there is a natural or induced drive energy within the formation sufficient for producting fluids. The improvement comprises: providing anode means in one well and cathode means in a second well and maintaining a unidirectional electrical potential gradient between the anode and cathode means; and producing oil from the anode-equipped well.

DESCRIPTION OF THE PREFERRED EMBODIMENT

THE PROCESS

The process of the present invention is practiced in an oil and water bearing formation wherein at least two spaced wells penetrate the formation. While the process is particularly applicable to heavy oil-bearing formations wherein the oil is characterized by an API gravity of less than 20, the process should be adaptable to most oil and water bearing formations.

Figure 1:
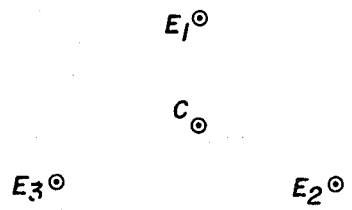
FIG. 1 shows two plan views of well patterns suitable for the process of this invention.
Figure 1:
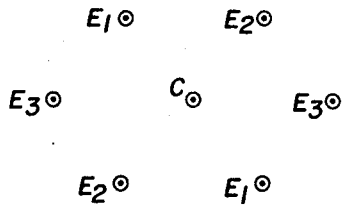

The process in a preferred embodiment is applied to a heavy oil-bearing formation such as the Athabasca tar sand deposits of Alberta, wherein the depth of overburden is prohibitive to mining recovery techniques. In this embodiment a 4- or 7-spot well pattern shown in FIG. 1 is established comprising perimeter wells E and a central well C. The well pattern is electrically preheated, using preferably a 3-phase power source applied to wells $E_1$, $E_2$ and $E_3$. If a poly-phase power source is used, the number of perimeter wells in a pattern is a whole number multiple of the number of phases present in the power source. Electrically preheating an oil-bearing formation with the use of for example, an A.C. current between spaced wells is a well known prior art technique and thus will not be described in detail herein. See for example U.S. Pat. No. 3,948,319 issued to Pritchett. It is sufficient to say, the well pattern is preheated to a temperature which would allow the oil to be mobilized under an acceptable pressure gradient. In most cases, the well pattern is preheated to an average overall temperature that does not exceed 150° C.

Following the preheat step, a hot injection fluid is introduced into the formation through an injection well which is preferably the central well C. The injection fluid is preheated to approximately the temperature of the formation. Any of the conventional displacement drive systems known in the prior art oil recovery methods should be suitable for the present invention. Exemplary of these fluids are the following flood drives: steam; water; brine; water and surfactant; water and polymer; water, surfactant and polymer; emulsions containing water, organic solvent and surfactant; and combinations thereof.

When surfactants are incorporated in the injection fluid, a surfactant should be chosen which does not affect the surface charges of the oil and formation material in a manner detrimental to the sought-after electrical effects on transport of the fluids within the reservoir, as will be subsequently explained. The surfactant must also be stable at the particular temperatures and pressures reached of the formation during the recovery process.

Simultaneous with the fluid injection, a unidirectional electrical potential gradient is applied between the central and perimeter wells. Electrodes are thus placed in the well bores adjacent to and in contact with the formation and suitably isolated from the well casing. In accordance with this invention and the polarity of the potential gradient is arranged to oppose or retard water flow toward the production well. In the majority of cases, the formation and injection fluid will be such that this effect is achieved by applying a positive potential to the production well and a negative potential to the injection well. In the well patterns shown in FIG. 1, the injection well is preferably the central well C, and the production wells are the perimeter wells E.

The unidirectional electrical potential gradient may utilize polarized currents such as filtered D.C., pulsating D.C. and eccentric A.C. having a net polarized effect. The use of pulsating or steady D.C. may require the application of depolarizing reversals of the potential. Depolarization cycles should however be kept short in duration so as not to deleteriously affect the direction of fluid flow within the formation.

The voltage which is used is of course dependent on the resistivity of the formation which in turn varies as the water or displacement drive displaces the oil within the formation. In general, the voltage used is sufficient to induce the desired electroosmotic effect which is apparent, for example, by observing an increase in the pressure drop across the formation.

The upper temperature limit achieved in the heavy oil-bearing formation should not exceed the vaporization temperature of the water and/or hydrocarbons within the formation. Extensive vaporization could produce electrical discontinuities under the existing or induced reservoir pressure conditions. In those cases in which the injection fluid includes a polymer or surfactant, the upper temperature limit is defined by the stability of those components.

The lower temperature limits are defined by the pressure drop limitations imposed by the overburden on the formation. It is desirable for good sweep efficiency to operate below the formation fracture pressure. As the temperature of the preheated formation drops, the oil viscosity increases, resulting in a less mobile system throughout the formation. The pressure differential required to move these fluids is thus increased. This pressure gradient, if it exceeds the overburden pressure can result in a fracture, producing an undesirable permeability disturbance to the formation which can ultimately decrease the sweep efficiency of the displacement medium.

Production fluids, including formation fluids and at least a portion of the injected fluids, are recovered from the production well. An inverse pattern mode can be employed wherein the perimeter wells E are used as injection wells and the central well C as the production well. The central well would then become the positive power source.

Once fluids are produced from the production well, the voltage can be adjusted to reduce the amount of water in the production fluids.

With this imposed potential a number of electrokinetic, electrochemical and thermal effects take place, however the principal factor producing the enhanced oil recoveries is believed to be electroosmosis. In practicing the process thus far, it has been observed that by maintaining a positive potential at the producing end of a heavy oil-bearing zone the flow of water was opposed or retarded toward that end. There is also evidence suggesting that this particular electrode configuration favored the flow of the oil phase to the producing end, or at least the retarding effect on the oil was less than that on the water. A word of caution however is in order here. Some systems of displacement drive fluids used with these or other types of reservoir materials could result in a different directional effect, although this has not yet been observed in this work. It is therefore desirable to confirm the net directional effect on the fluid flow by testing in a suitably assembled core.

It should be understood that in a more conventional oil-bearing formation wherein the oil is characterized as having an API gravity greater than about 20, the preheating and fluid injection steps may be omitted depending on the water content and drive energy in the formation.

In such cases where there is sufficient drive energy within a formation for producing fluids an electrode can be provided in each of at least two spaced wells penetrating the formation and oil recovered from the anode equipped well.

EXPERIMENTAL

In order to demonstrate the operability of the process of the present invention a number of experiments were performed in a laboratory cell. Oil sand, obtained from the Fort MacMurray area of the Athabasca tar sand deposit, was compacted into a 2"d.×20" l. Fibercast* pipe to give a sand density of 1.95 to 1.98 g/cc. The Fibercast pipe provided suitable insulation of the electrodes. The pipe, set vertically was provided with electrodes at both ends and a sand filter at the upper end of the pipe, in contact with the oil sand. The cell was electrically preheated to about 90° C. with a furnace surrounding the pipe. An injection fluid, as described in the following examples, was preheated to about 90° C. and injected at a controlled rate into the bottom of the pipe. A unidirectional potential gradient was established between the electrodes at opposite ends of the pipe, the upper end being poled as the anode. The voltage used across the packed bed of oil sand was randomly chosen at 400 V. The current was observed to increase from an initial 5 milliamps to a limit of less than 100 milliamps as the displacement proceeded. No depolarization procedures were used on the electrodes which were a porous stainless steel. As fluids were passed through these electrodes continuous operation was possible without the use of depolarizing reversals of the applied potential.

*Registered Trade Mark of Youngstown Sheet and Tube Co., Fibercast Co. division, Oklahoma.

The conditions chosen for the operation of the process are not intended to imply any restrictions to the process, but were used as reference conditions to illustrate in the laboratory the advantages attainable with the use of the superimposed unidirectional potential. Further, the examples are not intended to illustrate the optimal performance that can be obtained by the process. The examples show that under extraction conditions which are maintained alike in all other respects except for the use of the superimposed D.C. in one case and not in the other, the addition of the electrical potential across the oil sand pack produces improved recoveries.

EXAMPLE 1

| | |
|---|---|
| Injection Fluid Composition: | |
| 0.033 N NaCl Brine | 100 parts by weight |
| Dow Separan MG-700[1] | 0.2 parts by weight |
| Combined anionic, non-ionic surfactant[2] | 2 parts by weight |
| Injection Rate: | |
| 2.5 ft./day to a total of 1.5 pore volumes. | |

[1]A polyacrylamide pusher supplied by Dow Chemical Co., Midland, Michigan.
[2]Where surfactants were employed in the injection fluid, they were a blend of anionic and non-ionic material obtained from W.E. Greer Ltd., Edmonton, Alberta, under the chemical description of a blended cocodiethanolamine and phosphated nonylphenoxy-polyethoxy ethanols.

The results given in Table 1 show the core analysis following the above described extraction procedure with and without the superimposed D.C. potential. The initial bitumen content of the oil sands was approximately 15%. Clearly the recovery is improved by imposing the D.C. potential negative to positive between injection and production points respectively when the injection fluid is a mobility-adjusted surfactant flood, as evidenced by the lower residual bitumen content in the core.

TABLE 1

CORE ANALYSIS AFTER EXTRACTION
INITIAL BITUMEN CONTENT - 15%

| With Superimposed D.C. | | | Without D.C. | | |
|---|---|---|---|---|---|
| Bottom of Core | % of | Top of Core | Bottom of Core | % of | Top of Core |
| 94.02 | Solids | 83.65 | 81.41 | Solids | 82.93 |
| 0.40 | Bitumen | 3.77 | 6.76 | Bitumen | 10.35 |
| 5.50 | Water | 11.95 | 10.73 | Water | 6.16 |
| 99.92 | Totals | 99.37 | 98.90 | Totals | 99.44 |

EXAMPLE 2

Injection Fluid Composition:

| | |
|---|---|
| Refined kerosene at an injection rate of 2.5 ft./day to a total of 0.20 pore volumes, followed by | |
| 0.033 N NaCl brine | 100 parts by weight |
| Dow Separan MG-700 | 0.2 parts by weight |
| at an injection rate of 2 ft./day to a total of 1.5 pore volumes. | |

The results of Table 2 illustrate that the use of a solvent slug ahead of the water based displacement drive does not deter from the effectiveness of the superimposed D.C. potential.

TABLE 2

CORE ANALYSIS AFTER EXTRACTION
INITIAL BITUMEN CONTENT - 15%

| With Superimposed D.C. | | | Without D.C. | | |
|---|---|---|---|---|---|
| Bottom of Core | % of | Top of Core | Bottom of Core | % of | of Core |
| 79.50 | Solids | 82.95 | 81.72 | Solids | 83.00 |
| 1.94 | Bitumen | 4.59 | 4.16 | Bitumen | 8.96 |
| 16.62 | Water | 10.91 | 13.37 | Water | 6.15 |
| 98.06 | Totals | 98.45 | 99.25 | Totals | 98.11 |

EXAMPLE 3

In the following example, 0.36 pore volumes of a water based emulsion was injected followed by 1.45 pore volumes of a polymer thickened pusher.

Emulsion Composition:

| | |
|---|---|
| 0.2N NaCl brine | 40.3 parts by weight |
| Refined Kerosene | 32.7 parts by weight |
| Blended anionic, non-ionic surfactant | 26.9 parts by weight |

Polymer Pusher Composition:

| | |
|---|---|
| Distilled water | 83.17 parts by weight |
| 0.2N NaCl brine | 16.63 parts by weight |
| Dow Separan MG-700 | 0.20 parts by weight |

TABLE 3

CORE ANALYSIS AFTER EXTRACTION
INITIAL BITUMEN CONTENT - 15%

| With Superimposed D.C. | | | Without D.C. | | |
|---|---|---|---|---|---|
| Bottom of Core | % of | Top of Core | Bottom of Core | % of | Top of Core |
| 82.77 | Solids | 86.23 | 79.52 | Solids | 84.50 |
| 1.01 | Bitumen | 5.24 | 1.19 | Bitumen | 8.66 |
| 14.27 | Water | 7.78 | 14.98 | Water | 5.22 |
| 98.05 | Totals | 99.25 | 95.69 | Totals | 98.38 |

It is evident from the results of Examples 1 and 3 that the lower cost polymer injection fluids can perform better recoveries than the high cost emulsion flood systems if the former is enhanced with the superimposed unidirectional potential gradient in a direction to oppose or retard the water flow toward the production point. A trade-off of electrical energy versus chemical costs is therefore possible.

EXAMPLE 4

| | |
|---|---|
| Injection Fluid Composition: | Distilled water |
| Injection Rate: | 2.5 ft/day to a total of 1.6 pore volumes |

TABLE 4

CORE ANALYSIS AFTER EXTRACTION
INITIAL BITUMEN CONTENT - 15%

| With Superimposed D.C. | | | Without Superimposed D.C. | | |
|---|---|---|---|---|---|
| Top of Core | Component | Bottom of Core | Top of Core | Component | Bottom of Core |
| 83.74 | Solids % | 82.57 | 83.59 | Solids % | 82.72 |
| 10.98 | Bitumen % | 8.34 | 11.33 | Bitumen % | 11.00 |
| 4.52 | Water % | 7.88 | 3.70 | Water % | 4.97 |

TABLE 4-continued

| CORE ANALYSIS AFTER EXTRACTION INITIAL BITUMEN CONTENT - 15% | | | | | |
|---|---|---|---|---|---|
| With Superimposed D.C. | | | Without Superimposed D.C. | | |
| Top of Core | Component | Bottom of Core | Top of Core | Component | Bottom of Core |
| 99.24 | Total % | 98.79 | 98.62 | Totals % | 98.69 |

In this case, both the electrically enhanced and non-enhanced recoveries were relatively poor because of the unfavorable mobility ratio of the drive fluid to the oil bank. The superimposed D.C. case does however show improved recovery results over the straight hot water displacement case.

The use of distilled water illustrates that high concentrations of electrolyte are not essential to the electrically enhanced procedure. The level of electrolyte can be thus chosen to affect other than the current flow. For instance the concentration of electrolyte can be varied to provide an optimum fluid salinity at which the surfactant is interfacially most active. Electrolyte concentration also affects the electrical resistivity and fluid permeability reservoir requirements. Higher voltages increases the electroosmotic effect.

While the present invention has been described in terms of a number of illustrative embodiments, it should be understood that it is not so limited, since many variations of the process will be apparent to persons skilled in the related art without departing from the true spirit and scope of the present invention.

The embodiments of the invention in which an exclusive property or privilege is claimed are defined as follows:

1. In a process for recovering oil from an oil and water bearing formation wherein spaced injection and production wells penetrate the formation and a drive fluid is injected into the formation through the injection well and to assist in producing oil and some water through the production well, the improvement comprising:

maintaining a unidirectional electrical potential gradient between anode means located in the production well and cathode means located in the injection well adjacent the formation, to retard water flow to the production well.

2. A process for recovering oil from a heavy oil-bearing formation wherein spaced injection and production wells penetrate the formation comprising:

preheating the formation between the two wells to a temperature which permits oil to be mobilized under an acceptable pressure gradient;

introducing heated injection fluids through the injection well into the formation; and maintaining a unidirectional electrical potential gradient between anode means located in the production well and cathode means located in the injection well adjacent the formation, to retard water flow to the production well.

3. The process as set forth in claim 2 wherein the injection fluid is selected from the group consisting of water; steam; brine; water and a surfactant; water and a polymer; water, a polymer, and a surfactant; an emulsion containing water, organic solvents and surfactant; and combinations thereof.

4. In a process for recovering oil from an oil and water bearing formation wherein at least two spaced wells penetrate the formation and there is a natural or induced drive energy within the formation sufficient for producing fluids.

the improvement comprising:

providing anode means in one well and cathode means in a second well and maintaining a unidirectional electrical potential gradient between the anode and cathode means; and producing oil from the anode-equipped well.

* * * * *